US011828551B1

(12) United States Patent
Moyer et al.

(10) Patent No.: US 11,828,551 B1
(45) Date of Patent: Nov. 28, 2023

(54) TRIGGER ASSEMBLY

(71) Applicants: Micaiah Moyer, Anderson, SC (US); Richard Vasquez, Anderson, SC (US)

(72) Inventors: Micaiah Moyer, Anderson, SC (US); Richard Vasquez, Anderson, SC (US)

(73) Assignee: Micaiah Moyer, Anderson, SC (US)

( * ) Notice: Subject to any disclaimer, the term of this patent is extended or adjusted under 35 U.S.C. 154(b) by 0 days.

(21) Appl. No.: 17/902,812

(22) Filed: Sep. 3, 2022

(51) Int. Cl.
*F41A 19/24* (2006.01)
*F41A 19/10* (2006.01)
*F41A 17/56* (2006.01)

(52) U.S. Cl.
CPC ..... *F41A 19/10* (2013.01); *F41A 17/56* (2013.01); *F41A 19/24* (2013.01)

(58) Field of Classification Search
CPC ..... F41A 19/24; F41A 19/10; F41A 17/56
See application file for complete search history.

(56) References Cited

U.S. PATENT DOCUMENTS

| | | | | |
|---|---|---|---|---|
| 3,983,654 | A | 10/1976 | Vironda | |
| 10,337,818 | B1 * | 7/2019 | Sampson, Jr. | F41A 3/66 |
| 11,248,868 | B2 | 2/2022 | Franssen | |
| 2019/0186858 | A1 * | 6/2019 | Foster | F41A 17/46 |
| 2020/0191513 | A1 * | 6/2020 | Foster | F41A 19/16 |

FOREIGN PATENT DOCUMENTS

WO 2016146242 9/2016

OTHER PUBLICATIONS https://www.thefirearmblog.com/blog/2016/01/11/yep-its-legal-available-fire-on-pull-release-triggers/.

* cited by examiner

*Primary Examiner* — J. Woodrow Eldred
(74) *Attorney, Agent, or Firm* — Edison Law Group

(57) ABSTRACT

A trigger assembly is disclosed. The trigger assembly contains a trigger containing an outer surface, a sear engagement member pivotally coupled with the outer surface of the trigger, and a spring member positioned between the outer surface and the sear engagement member.

14 Claims, 6 Drawing Sheets

TRIGGER ASSEMBLY

FIELD

The present invention relates to a firearm. More particularly, the present invention relates to a trigger assembly for a firearm.

BACKGROUND

A trigger assembly known in the art includes a pull trigger that is pulled by a user's finger. The pull trigger actuates a firing pin group when the trigger is pulled back by the user's finger. The bolt group drives the firing pin into the primer of the bullet. The primer explodes thereby igniting the powder in the bullet. One of the drawback of a traditional pull trigger is the natural pulling motion on a pull trigger which tends to pull the end of the rifle upwardly thus reducing accuracy. Accordingly, there is need for a solution to the aforementioned problem. For instance, there is an established need to improve shot placement when firing a rifle.

Figure 1:
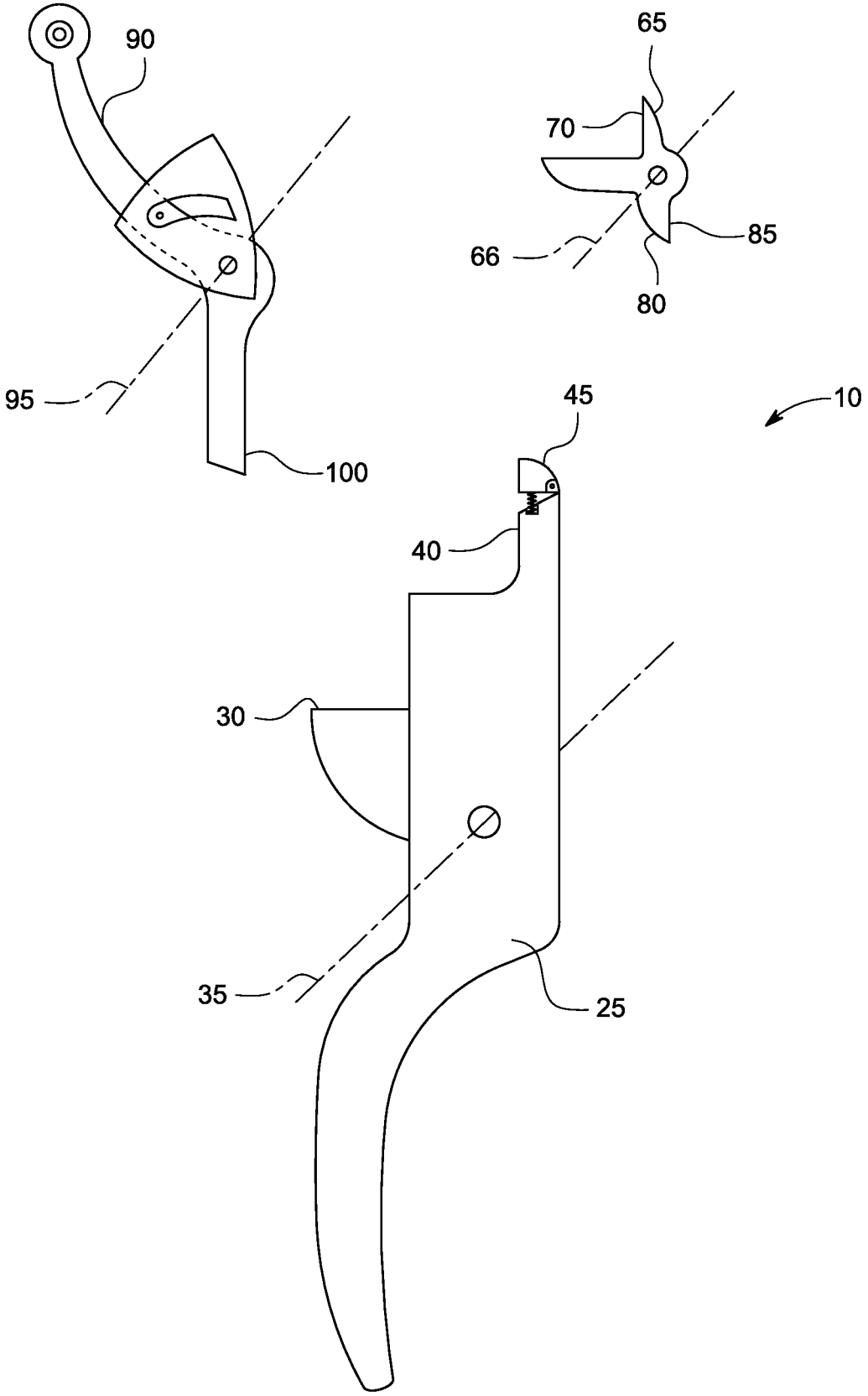
FIG. 1 depicts an exploded view of a trigger assembly according to some embodiments presently disclosed.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

According to some embodiments, a trigger assembly is presently disclosed. The presently disclosed trigger assembly is a release trigger assembly that is configured to actuate the firing pin group when the trigger is released by the shooter's finger (after first being pulled back), rather than when the trigger is pulled by the shooter. The rifle will only fire when the trigger is released. The presently disclosed release trigger assembly improves shot placement when firing a rifle. According to some embodiments, the presently disclosed trigger assembly may be designed as a drop-in trigger system for bolt action rifles.

FIG. 1 depicts an exploded view of a trigger assembly 10 according to some embodiments presently disclosed. The trigger assembly 10 may be positioned in a receiver (i.e. housing) 16 shown in FIGS. 2-4 and 6. FIGS. 2-4 and 6 depict a cutaway partial view of the receiver 16 of a firearm.

Figure 2A:
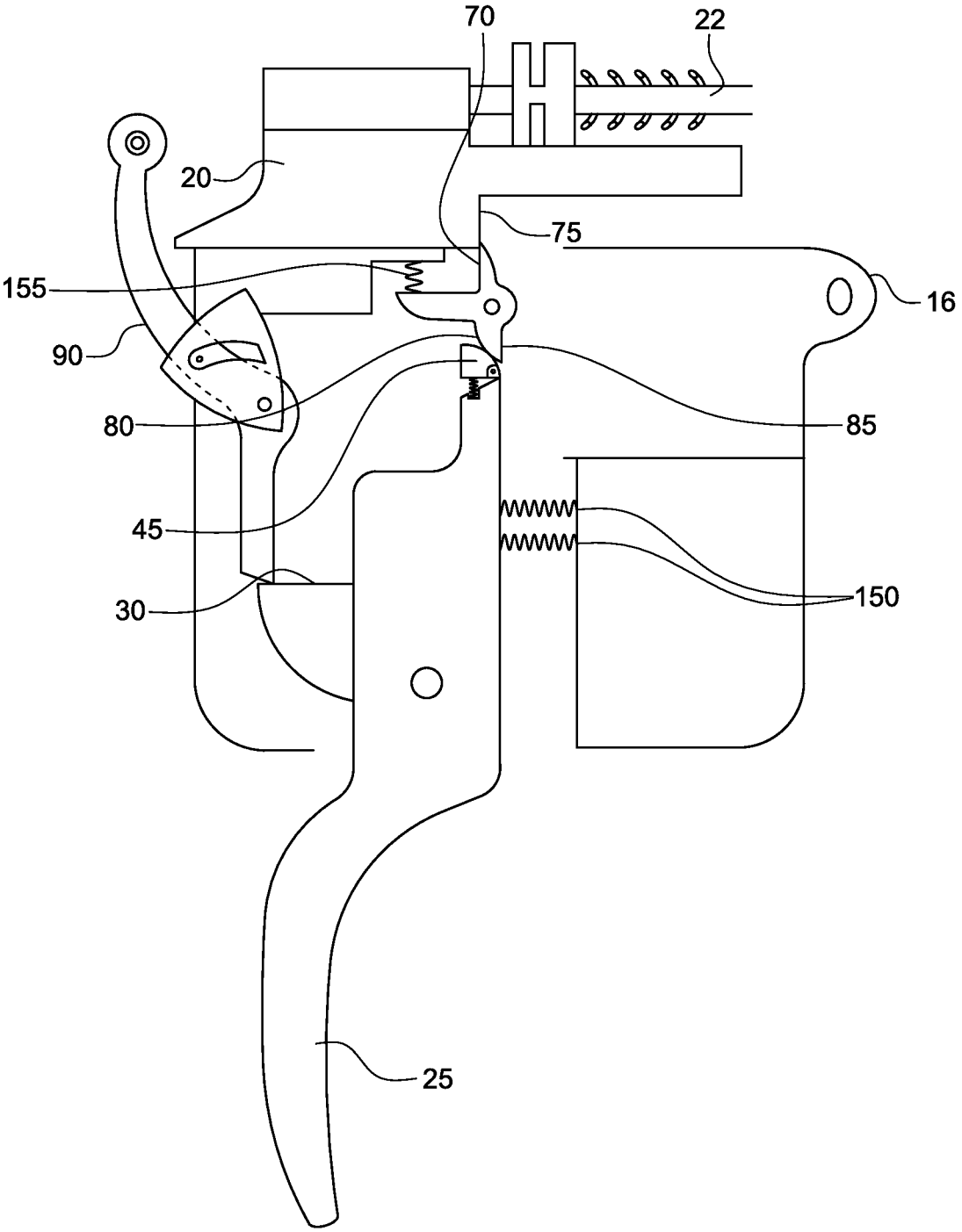
FIG. 2*a* depicts another view of the trigger assembly according to some embodiments presently disclosed.

The receiver 16 houses a firing pin group 20 and the trigger assembly 10. FIG. 2*a* depicts the firing pin group 20 and the trigger assembly 10 in detail. A firing pin 22 is positioned within the firing pin group 20. The firing pin 22 is movable between a cocked position and a released position.

According to some embodiments presently disclosed, the trigger assembly 10 comprises a trigger 25 pivotable about a trigger axis 35. The trigger 25 may comprise a spur 30 extending outwardly therefrom and an outer surface 40 positioned distal to the trigger axis 35.

Figure 5:
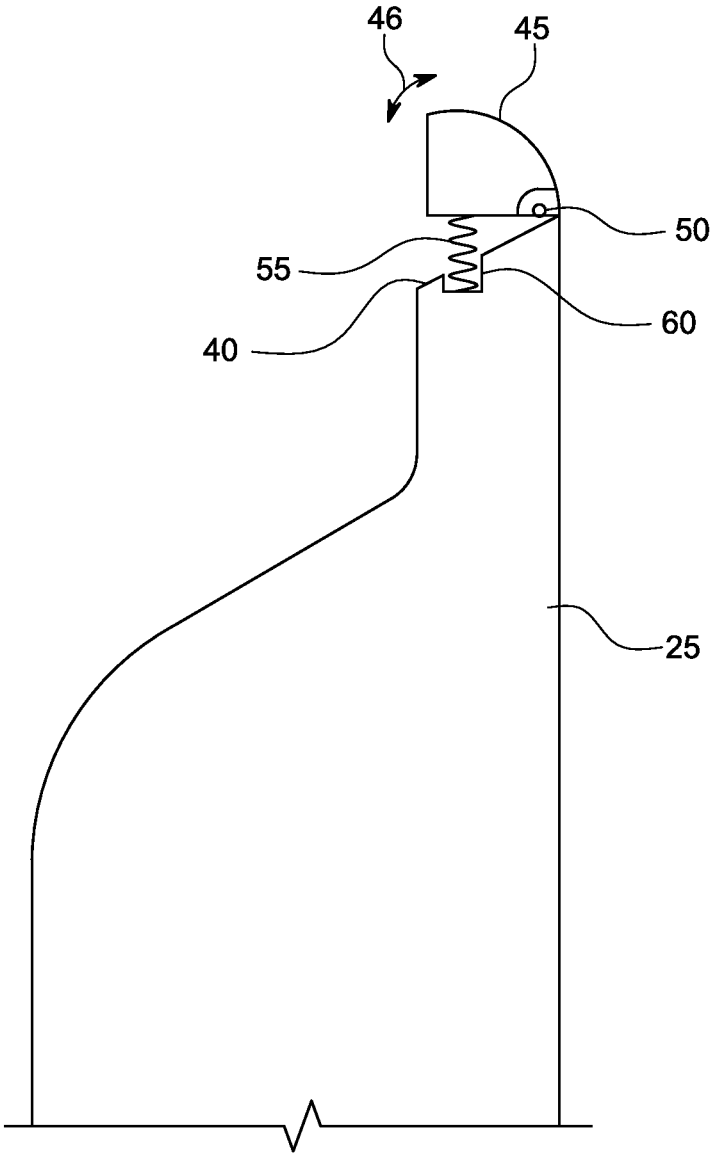
FIG. 5 depicts another view of the trigger assembly according to some embodiments presently disclosed.

The trigger 25 may also comprise a sear engagement member 45 pivotally coupled with the outer surface 40 of the trigger 25 as shown in FIG. 5. A pin 50 may be used to pivotably couple the sear engagement member 45 with the trigger 25. The sear engagement member 45 may pivot about the pin 50 as shown by arrow 46.

According to some embodiments, a spring member 55 may be positioned between the outer surface 40 and the sear engagement member 45 as shown in FIG. 5. According to some embodiments, the spring member 55 is sandwiched between the outer surface 40 and the sear engagement member 45. According to some embodiments, the outer surface 40 comprises an aperture 60 configured to accommodate at least a portion of the spring member 55. According to some embodiments, the sear engagement member 45 comprises an aperture (not shown) configured to accommodate at least a portion of the spring member 55.

According to some embodiments presently disclosed, the trigger assembly 10 comprises a sear 65 that is pivotable about a sear axis 66. According to some embodiments presently disclosed, the sear 65 comprises a first surface 70 engageable with a surface 75 of the firing pin group 20. According to some embodiments presently disclosed, the sear 65 comprises a second surface 80 and a third surface 85. According to some embodiments presently disclosed, the second surface 80 and the third surface 85 are engageable with the sear engagement member 45 as shown in FIGS. 2 and 3.

According to some embodiments presently disclosed, the trigger assembly 10 may comprise a safety assembly 90. The safety assembly 90 is positioned adjacent to the trigger 25 and is pivotable about a safety axis 95. The safety assembly 90 may comprise a projection 100 extending from safety assembly 90, the projection 100 being positioned distal to the safety axis 95.

The projection 100 permits the safety assembly 90 to engage the trigger 25 and prevent inadvertent discharge of the firearm. FIGS. 3 and 4 depict the trigger assembly 10 with the safety assembly 90 in the "fire" position (safety off). When safety assembly 90 is in the "fire" position the projection 100 does not engage the spur 30 of the trigger 25. When safety assembly 90 is in the "fire" position the triggers 25 may be used to fire the firearm as described below.

FIG. 2*a* depicts the trigger assembly 10 with the safety assembly 90 in the "safe" position. When safety assembly 90 is in the "safe" position the projection 100 engages the spur 30 of the trigger 25 and prevents the trigger 25 from pivoting about trigger axis 35. When the safety assembly 90 is in the "safe" position the triggers 25 is prevented from firing the firearm. The safety assembly 90 may be moved to the "fire" position by pivoting it (clockwise in FIG. 2) about its safety axis 95 through a predetermined. angle which disengages the projection 100 from the spur 30 of the trigger 25.

Figure 2B:
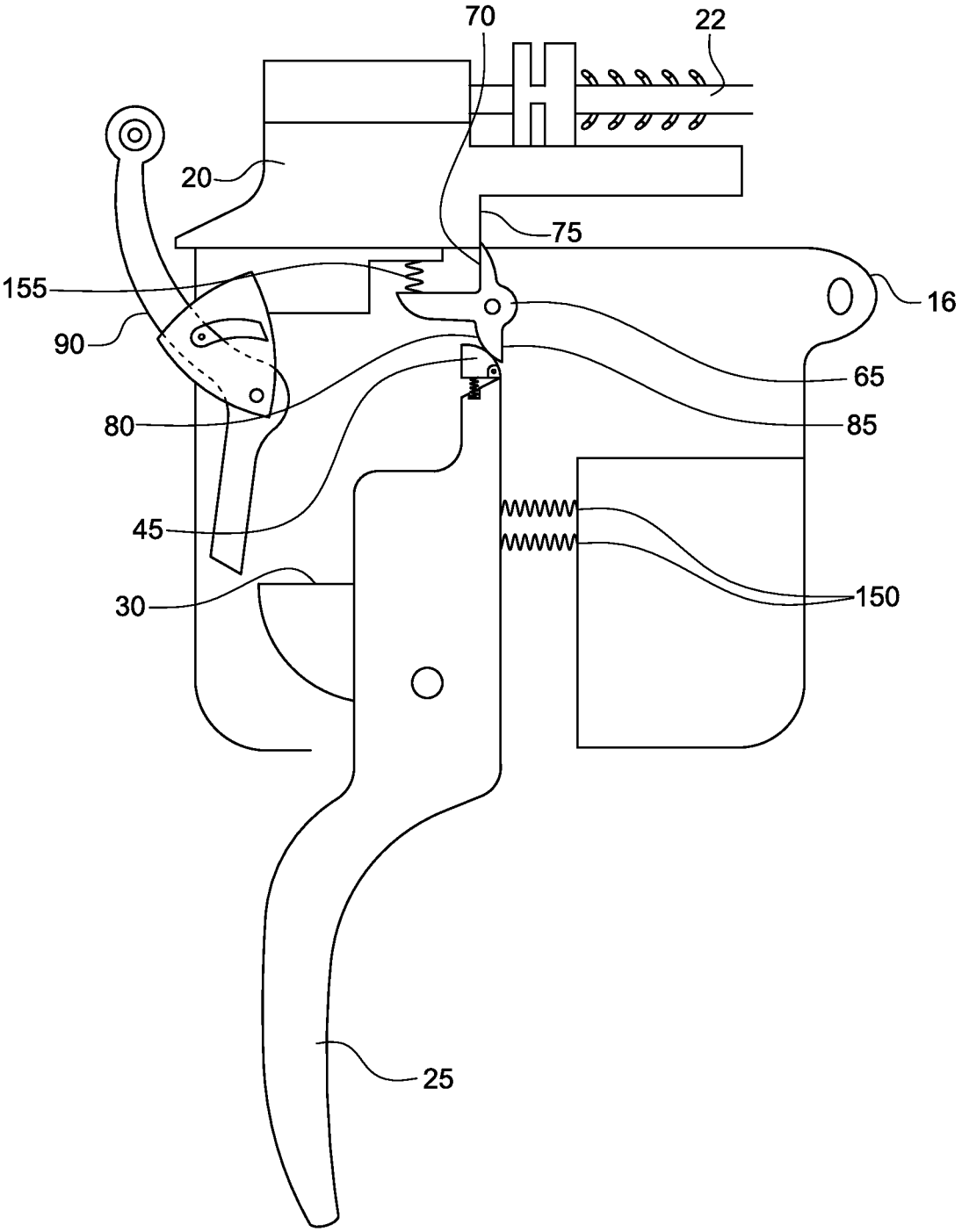
FIG. 2*b* depicts another view of the trigger assembly according to some embodiments presently disclosed.
Figure 3:
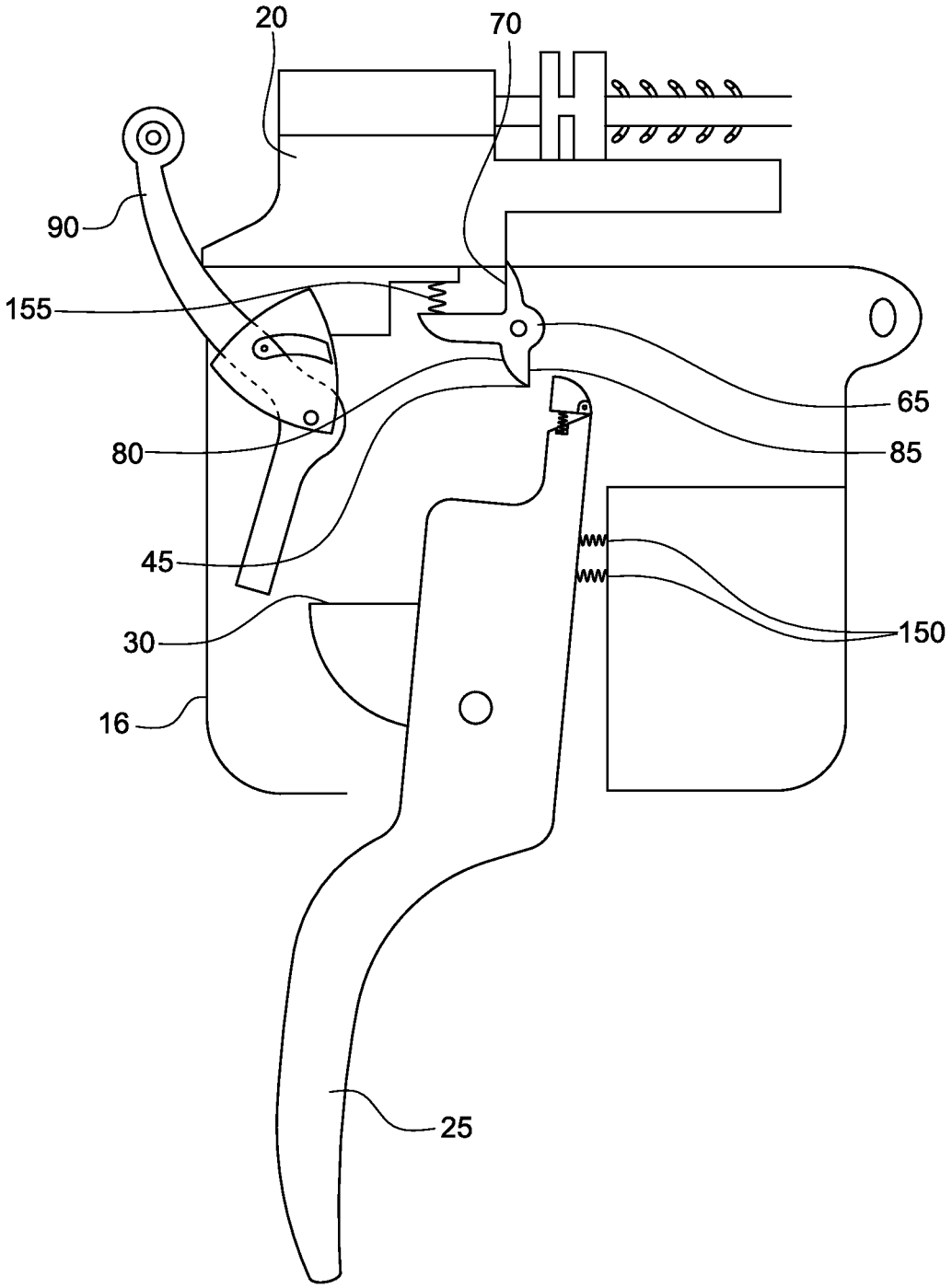
FIG. 3 depicts another view of the trigger assembly according to some embodiments presently disclosed.
Figure 4:
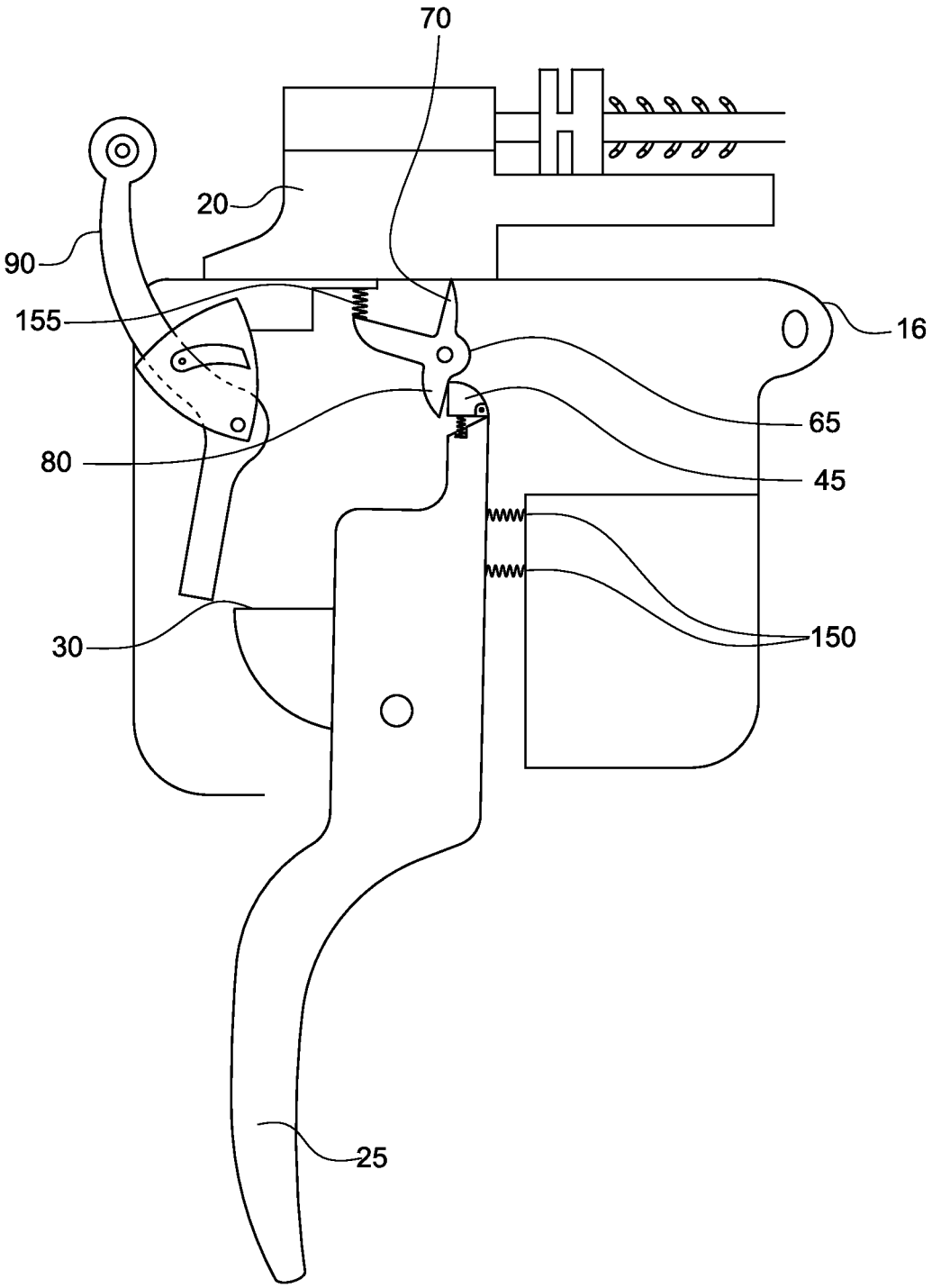
FIG. 4 depicts another view of the trigger assembly according to some embodiments presently disclosed.

FIGS. 2*b*-4 illustrate operation of the trigger assembly 10 to discharge the firearm. As shown in FIG. 2*b*, the safety assembly 90 is pivoted to the "fire" position and the firing pin group 20 is in the "cocked" configuration (spring compressed, firing pin held cocked by the sear 65). The trigger 25 is pulled from its resting position by pivoting about the trigger axis 35. According to some embodiments, pulling trigger 25 may cause one or more springs 150 to be compressed in the housing 16.

According to some embodiments, pulling trigger 25 causes the sear engagement member 45 to engage (i.e. abut) the second surface 80 of the sear 65. As the trigger 25 continues to be pulled, the second surface 80 forces the sear engagement member 45 to pivot downward (i.e. towards the outer surface 40) and compress the spring member 55. When the sear engagement member 45 is positioned beyond the second surface 80 (shown in FIG. 3), the sear engagement member 45 may produce a clicking sound as the sear engagement member 45 pivots upward (i.e. away from the outer surface 40) due to the upward force applied by the spring member 55. The clicking sounds could be used to notify the shooter that the firearm is ready to be fired.

As shown in FIG. 3, the sear engagement member 45 is positioned adjacent to the third surface 85 of the sear 65 and the firearm is ready to be fired. The trigger 25 is released and allowed to pivot about the trigger axis 35. Releasing the trigger 25 causes the one or more springs 150 to push the trigger 25 back to its resting position. As the trigger 25 is returning to its resting position, the sear engagement member 45 abuts the third surface 85 and causes the sear 65 to pivot from its resting position by pivoting about the sear axis 66 as shown in FIG. 4. As the sear 65 is pivoting from its resting position it releases the firing pin group which causes the firing pin 22 to strike a primer or the rim of a cartridge (not shown) to discharge the firearm. As the sear 65 is pivoting from its resting position it compresses spring member 155 inside the housing 16.

When the trigger 25 returns to is resting position, the sear engagement member 45 is positioned beyond the third surface 85 and adjacent to the second surface 80 (shown in FIG. 2*b*), When the sear engagement member 45 is positioned adjacent to the second surface 80, the sear 65 is returned to its resting position by the spring member 155 as shown in FIG. 2*b*.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A trigger assembly comprising:

a trigger comprising an outer surface;

a sear engagement member pivotally coupled with the outer surface of the trigger; and a spring member positioned between the outer surface and the sear engagement member;

wherein the spring member is compressed when the trigger is pulled away from a trigger resting position and the sear engagement member abuts a first surface of a sear;

wherein the sear engagement member abuts a second surface of the sear when the trigger is released.

2. The trigger assembly of claim 1, wherein the sear pivots away from a sear resting position when trigger is released.

3. The trigger assembly of claim 2, wherein the sear releases a firing pin group when the sear pivots away from the sear resting position.

4. The trigger assembly of claim 1, wherein the trigger comprises a spur for engaging a safety assembly.

5. The trigger assembly of claim 1 further comprising a pin for coupling the trigger with the sear engagement member.

6. The trigger assembly of claim 1, wherein the outer surface comprises an aperture configured to accommodate the spring member.

7. A firearm comprising:

a trigger comprising an outer surface;

a sear engagement member pivotally coupled with the outer surface of the trigger;

a spring member positioned between the outer surface and the sear engagement member;

a sear comprising a first surface for engaging a firing pin group;

wherein the spring member is compressed when the trigger is pulled away from a trigger resting position and the sear engagement member abuts a second surface of the sear;

wherein the sear engagement member abuts a third surface of the sear when the trigger is released.

8. The firearm of claim 7, wherein the sear pivots away from a sear resting position when trigger is released.

9. The firearm of claim 8, wherein the sear releases the firing pin group when the sear pivots away from the sear resting position.

10. The firearm of claim 7, wherein the trigger comprises a spur for engaging a safety assembly.

11. The firearm of claim 7 further comprising a pin for coupling the trigger with the sear engagement member.

12. The firearm of claim 7, wherein the outer surface comprises an aperture configured to accommodate the spring member.

13. The firearm of claim 7 further comprising one or more springs, wherein the one or more springs compress when the trigger is pulled away from the trigger resting position.

14. The firearm of claim 7 further comprising another spring member, wherein the another spring member compress when the sear pivots away from the sear resting position.

* * * * *